US010234242B2

(12) United States Patent
Castrati

(10) Patent No.: US 10,234,242 B2
(45) Date of Patent: Mar. 19, 2019

(54) WEARABLE SUPPORTING STRUCTURE FOR SUPPORTING BALLISTIC PROTECTIONS AND/OR MILITARY EQUIPMENT

(71) Applicant: MECH LAB S.r.l., Genoa (IT)

(72) Inventor: Maurizio Castrati, Florence (IT)

(73) Assignee: MECH LAB S.R.L., Genoa (IT)

( * ) Notice: Subject to any disclaimer, the term of this patent is extended or adjusted under 35 U.S.C. 154(b) by 18 days.

(21) Appl. No.: 15/288,765

(22) Filed: Oct. 7, 2016

(65) Prior Publication Data

US 2017/0102215 A1 Apr. 13, 2017

(30) Foreign Application Priority Data

Oct. 9, 2015 (IT) ..... 102015000060106

(51) Int. Cl.

| | |
|---|---|
| ***A41H 1/02*** | (2006.01) |
| ***A41D 1/00*** | (2018.01) |
| ***F41H 1/02*** | (2006.01) |
| ***A41D 1/04*** | (2006.01) |
| ***A45F 3/14*** | (2006.01) |
| ***F41H 5/013*** | (2006.01) |
| ***A45F 3/06*** | (2006.01) |
| ***A45F 3/08*** | (2006.01) |
| ***A45F 3/10*** | (2006.01) |
| *A45F 3/04* | (2006.01) |

(52) U.S. Cl.

CPC ..... *F41H 1/02* (2013.01); *A41D 1/002* (2013.01); *A41D 1/04* (2013.01); *A45F 3/06* (2013.01); *A45F 3/08* (2013.01); *A45F 3/10* (2013.01); *A45F 3/14* (2013.01); *F41H 5/013* (2013.01); *A45F 2003/045* (2013.01); *A45F 2003/144* (2013.01); *A45F 2003/146* (2013.01)

(58) Field of Classification Search

CPC .. A41H 1/02; A41D 1/002; A41D 1/04; A45F 3/06; A45F 3/10; A45F 3/14; A45F 2003/146; A45F 2003/045; F41H 5/013

USPC ..... 224/575, 259, 262, 631, 632, 633, 634

See application file for complete search history.

(56) References Cited

U.S. PATENT DOCUMENTS

| | | | | |
|---|---|---|---|---|
| 5,449,102 | A * | 9/1995 | Sason | A45F 3/047 224/632 |
| 7,287,677 | B2 * | 10/2007 | Reid | A45F 3/047 224/637 |
| 8,740,028 | B2 * | 6/2014 | Hairston | A45F 3/04 224/261 |
| 9,545,144 | B2 * | 1/2017 | Gill | A45F 3/04 |
| 2011/0198377 | A1 * | 8/2011 | Froidevaux | A45F 3/08 224/633 |

(Continued)

*Primary Examiner* — Nathan J Newhouse
*Assistant Examiner* — Lester L Vanterpool
(74) *Attorney, Agent, or Firm* — Seed IP Law Group LLP

(57) ABSTRACT

A wearable supporting structure for supporting ballistic protections and/or military equipment has a band suitable to be wrapped around the waist or hips of a user; a dorsal upright having a lower end coupled to the band and extending, in use, upwards from the band; a vest for supporting ballistic protections and/or other military equipment, coupled to the dorsal upright and comprising two shoulder straps; and a unit connecting the shoulder straps to the band; the connecting unit being motorised to be able to continuously adjust the position in height of the shoulder straps with respect to the band.

13 Claims, 4 Drawing Sheets

(56) References Cited

U.S. PATENT DOCUMENTS

| | | | | |
|---|---|---|---|---|
| 2013/0221051 | A1* | 8/2013 | Hairston | A45F 3/08 224/633 |
| 2014/0014700 | A1* | 1/2014 | Gill | A45F 3/04 224/637 |
| 2014/0151424 | A1* | 6/2014 | Hexels | A45F 3/06 224/637 |
| 2014/0305982 | A1* | 10/2014 | Pelland | A45F 3/06 224/576 |
| 2014/0361058 | A1 | 12/2014 | Gill et al. | |
| 2015/0211829 | A1* | 7/2015 | Cole | F41H 1/02 2/463 |
| 2016/0033235 | A1* | 2/2016 | Kinnings | F41H 1/02 2/102 |

* cited by examiner

WEARABLE SUPPORTING STRUCTURE FOR SUPPORTING BALLISTIC PROTECTIONS AND/OR MILITARY EQUIPMENT

BACKGROUND

Technical Field

The present invention relates to a wearable supporting structure for supporting ballistic protections and/or military equipment.

Description of the Related Art

Both in the military and civilian fields, the need is felt to carry loads on the back or on the shoulders, however, without overloading the user's spinal column or creating localized stress.

For this purpose, structures are known which have two shoulder straps that support the load and are connected to a lumbar band, which is wrapped around the waist or hips of the user, so as to shift at least part of the weight from the shoulders to the lumbar area of the user by means of said lumbar band.

With specific reference to the military field, to which the following discussion will make explicit reference without thereby losing generality, the structure supports ballistic protections, which are rigid plates of considerable weight and thickness. In addition to this, the structure is arranged to support a considerable amount of equipment such as, for example, light and medium weaponry, ammunition, sensors, material for specific missions, food and water supplies to allow for operativeness under extreme weather conditions.

In known arrangements, under certain conditions, the entire war load weighs almost entirely on the shoulders of the user, causing, in use, abrasions and localized traumas due to unavoidable pressure and rubbing.

In other solutions, the load acts for the most part on the spine causing physical problems in the short and in the long term.

The ballistic protections, wrapping by nature and made of non-breathable materials, were experimentally shown to inhibit the natural thermoregulation; this entails high consumption of liquids, a risk of dehydration in demanding situations and, in any case, a proven decrease in the efficiency of the user.

Today, arrangements of structures are known in which the shoulder straps are connected to a lumbar band through a dorsal bar, which extends behind the user's back and is defined by a substantially vertical bar. The dorsal bar, at the lower end, is coupled to the lumbar band by means of a joint and, at the upper end, is coupled to the two shoulder straps by means of a fixed plate. The fixed plate is shaped so as to be coupled to corresponding seats made in the dorsal bar.

A number of seats is provided, the seats being mutually aligned in a vertical direction so as to allow for a discrete adjustment of the position of the shoulder straps with respect to the dorsal bar and for the adjustment of the supporting structure for people having different builds and/or heights. The position in height set for the shoulder straps is then locked by means of a tooth integral with the aforesaid plate, which passes through the aforesaid dorsal bar and can be locked in rectangular slots made in mutually spaced positions along the dorsal bar.

Today, the need is felt to facilitate the adjustment in height of the shoulder straps with respect to the lumbar band without having to manually operate the mechanism that locks/unlocks the locking tooth and to manually adjust the height of the tooth itself. In particular, the need is felt to be able to easily adjust the height of the shoulder straps even when the supporting structure has already been put on, as well as to be able to adjust the position of the shoulder straps in a very short time and without physical effort.

BRIEF SUMMARY

An object of the present invention is to provide a wearable supporting structure for supporting ballistic protections and/or military equipment, which allows the above needs to be met in a simple and inexpensive way.

According to at least one embodiment of the present invention, a wearable supporting structure for supporting ballistic protections and/or military equipment is provided, the supporting structure comprising a band suitable to be wrapped around the waist or hips of a user; a dorsal upright having a lower end coupled to said band and extending, in use, upwards from said band; supporting means for supporting ballistic protections and/or other military equipment, the supporting means being coupled to said dorsal upright and comprising two shoulder straps having respective rear end portions facing said dorsal upright; and connection means connecting said rear end portions to said band; characterised in that said connection means comprise motorised adjustment means for the continuous adjustment of the position in height of said rear end portions with respect to said band.

Preferably, in the structure defined above, the motorised adjustment means comprise a rope transmission and a motor operating said rope transmission.

Conveniently, moreover, the rope transmission comprises a driving wheel arranged at the height of said band and operated by said motor; a driven wheel carried by said dorsal upright; and a rope wound in a loop on said wheels; said wheels being rotatable about respective hinge axes placed at a fixed distance from each other.

Preferably, moreover, said motorised adjustment means further comprise a rectilinear guide integrally connected to the band and extending along the dorsal upright; the rectilinear guide, in the given example, coincides, but not necessarily, with the dorsal upright; the motorised adjustment means further comprise a slide sliding in opposite directions along the guide under the thrust of said rope transmission; the rear end portions of the shoulder straps both being stably connected to said slide.

Conveniently, the motorised adjustment means also comprise a worm screw-worm wheel transmission interposed between the motor and said rope transmission. The worm screw and worm wheel combination ensures a high reduction ratio and allows for the use of a motor with reduced power and size and rotating at high rotational speeds, so as to always obtain a sufficient output torque for a continuous and precise adjustment and distribution of the load.

BRIEF DESCRIPTION OF THE SEVERAL VIEWS OF THE DRAWINGS

The invention will now be described with reference to the accompanying drawings, which illustrate a non-limiting embodiment thereof, in which.

DETAILED DESCRIPTION

Figure 1:
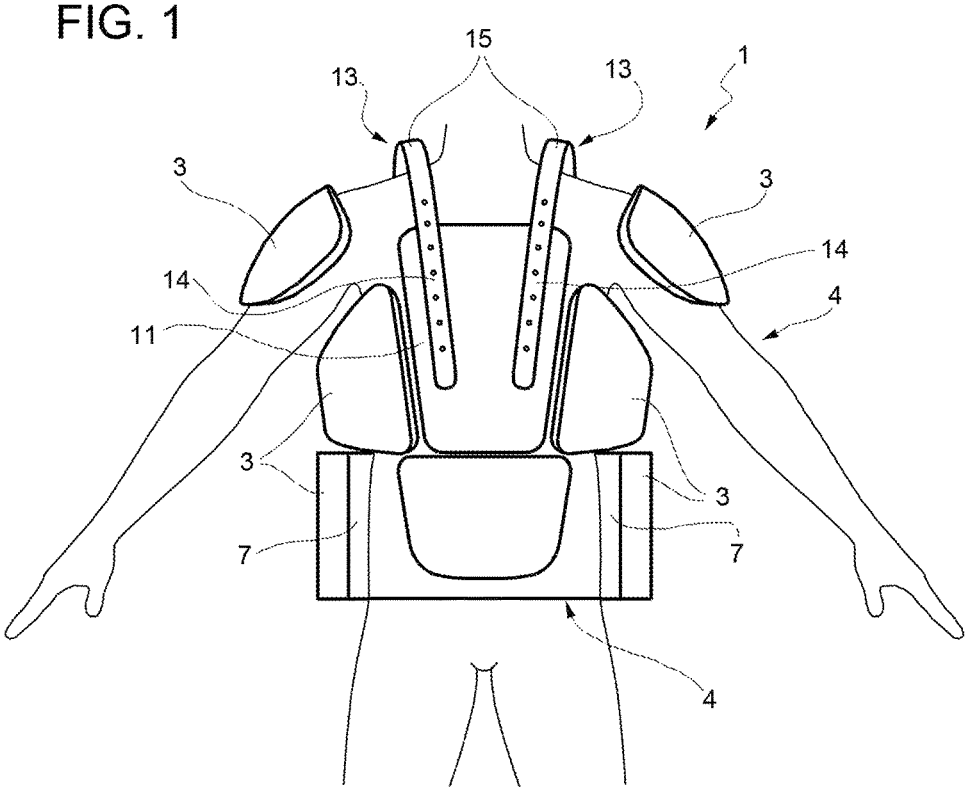
FIGS. 1 and 2 illustrate schematically and substantially in block form, front and rear views, respectively, of a preferred embodiment of the wearable supporting structure for supporting a ballistic protection, according to the present invention.

In FIGS. 1 to 4, 1 denotes, as a whole, a supporting structure for supporting ballistic protections 3 and/or military equipment, such as, for example, weapons, ammunition, sensors, material for specific missions, food/water supplies, backpacks, etc. not visible in the attached figures, worn by a user 2.

The supporting structure 1 comprises a lumbar band 4 (partially illustrated in FIG. 1), wrapped, in use, around the waist or hips of the user 2 and comprising an intermediate rear portion 6 and two side portions 7, which are joined together by portion 6 and hook to each other in a releasable manner in front of the pelvis of the user 2 in a known way.

The supporting structure 1 further comprises a spinal prosthesis or a dorsal upright 9, which extends in a substantially vertical direction and has a lower end 10 coupled to the portion 6 of the lumbar band 4, preferably in a releasable manner and, conveniently, by snap action.

Figure 4:
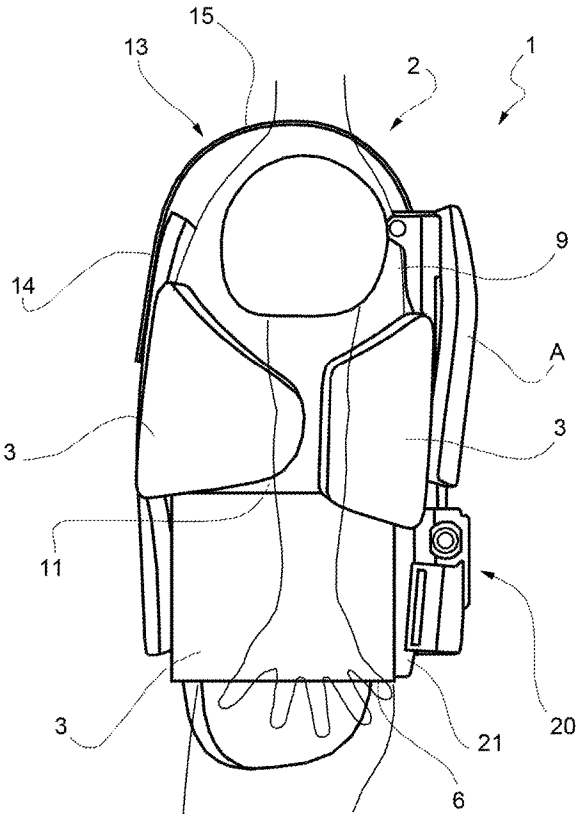
FIGS. 3 and 4 are figures similar to FIGS. 1 and 2 and they illustrate a side view of the supporting structure arranged in two different operating conditions.
Figure 3:
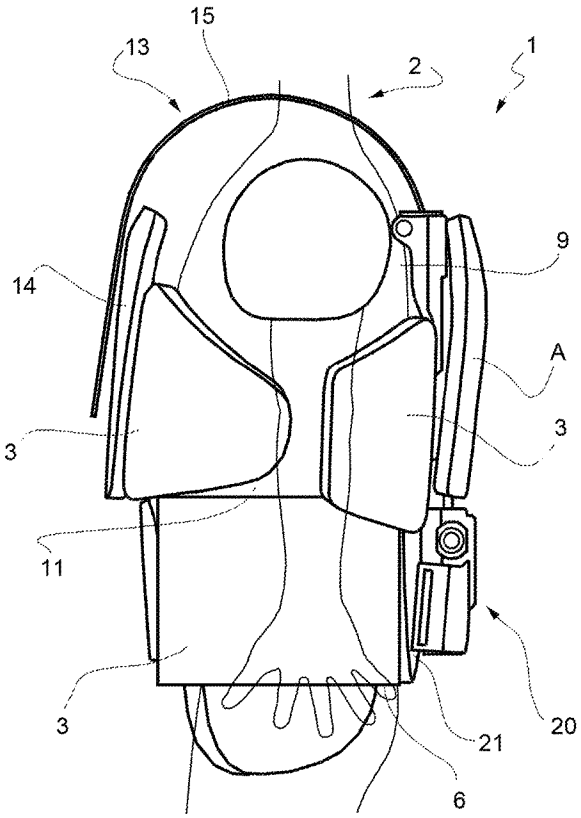

The supporting structure also comprises a vest 11 for attaching the ballistic plates 3 and for supporting other war loads when present, per se known and only partly visible in FIGS. 1, 3 and 4. The vest 11 is connected in a known manner to the dorsal upright 9 and comprises two shoulder straps 13, schematically illustrated, preferably of the thin plate or flexible band type, coated or uncoated with padding materials, not shown. The shoulder straps 13 have respective front portions 14 that can be connected in a per se known manner to the attaching vest, respective intermediate portions 15 which extend above the shoulders of the user 2 and respective rear end portions 16.

The rear portions 16 are coupled to the lumbar band 4 by means of a motorised unit for the continuous adjustment of the position of the end portions 16 with respect to the lumbar band 4 and indicated by the numeral 20.

Figure 5:
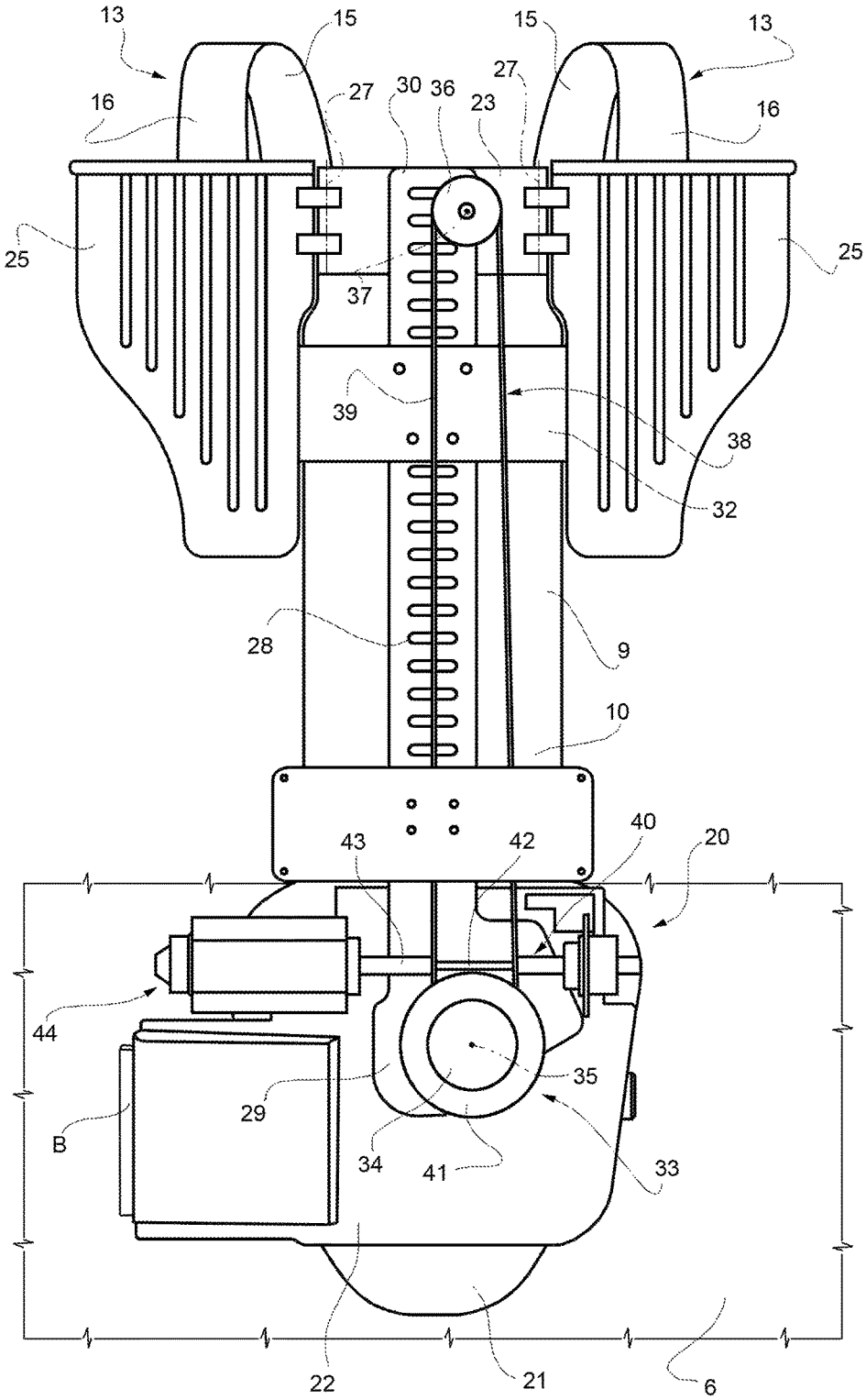
FIGS. 5 and 6 illustrate, in a highly enlarged scale and with parts removed for clarity, a detail of FIGS. 2 to 4.

With reference to FIGS. 3 and 4 and, in particular, to FIGS. 4 and 5, the unit 20 comprises a coupling plate 21 fixed to the intermediate portion 6 of the lumbar band 4, and a lower hollow rigid body 22 superimposed on, and connected to, the coupling plate 21. The hollow body 22 is stably coupled to the plate 21 or is coupled to the plate 21 itself in a releasable manner, conveniently by means of a releasable snap-on coupling device.

The unit 20 also comprises a further upper hollow rigid body 23 fixed to an upper end portion of the dorsal upright 9. The hollow body 23, for each shoulder strap 13, supports a respective guide body 25 for said shoulder strap 13. The guide bodies 25 are arranged on opposite lateral sides of said hollow body 23 and are hinged to said hollow body 23 so as to rotate freely with respect to the hollow body 23 about respective hinge axes 27 parallel to each other and extending, in use, in a substantially vertical direction.

Figure 6:
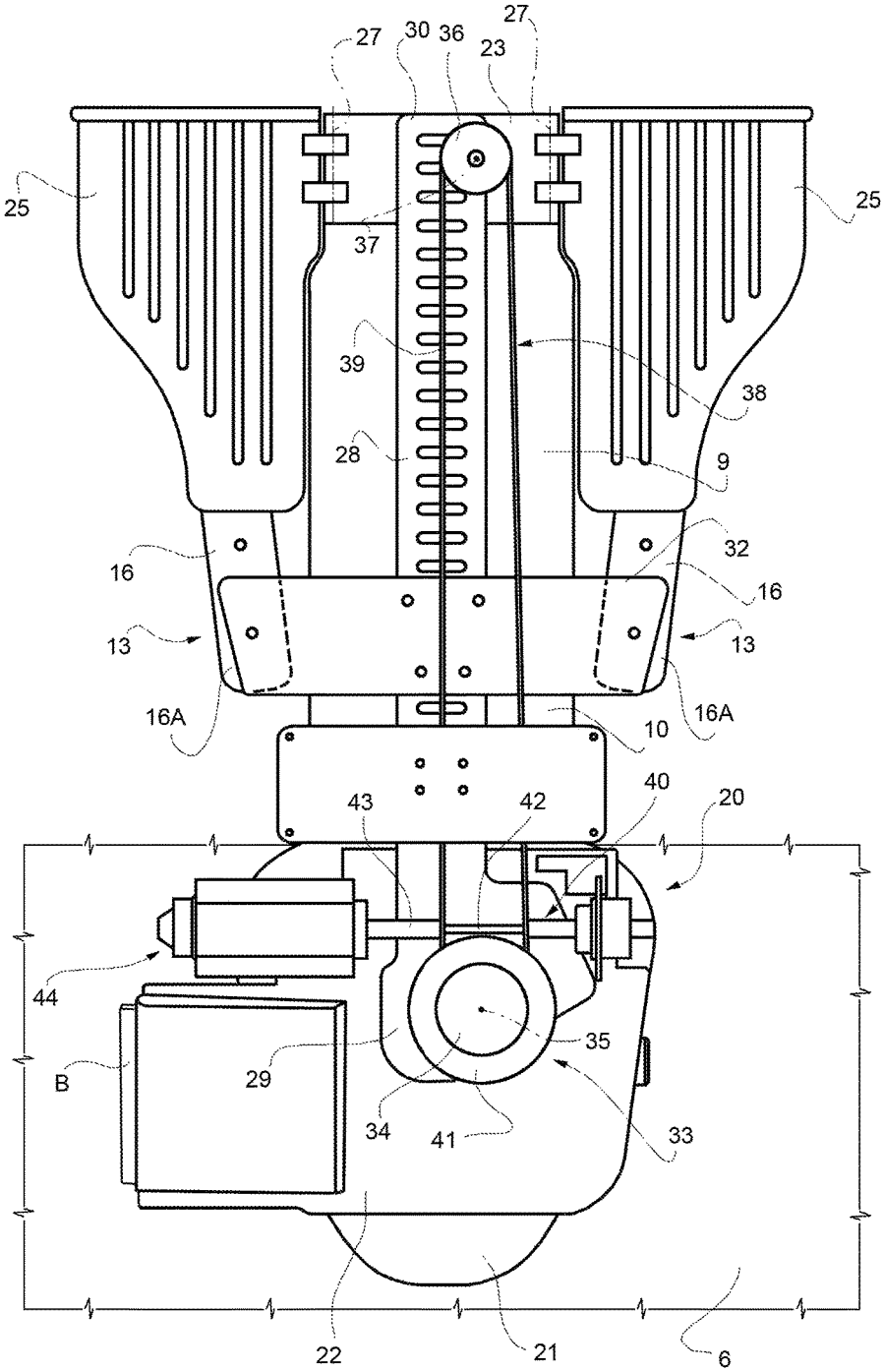

The rear portions 16 of the shoulder straps 13 pass through the respective guide bodies 25 and have respective end portions 16A protruding downwards beyond the respective guide bodies 25 themselves (FIG. 6).

Again with reference to FIGS. 5 and 6, the unit 20 further comprises a guide 28, preferably rectilinear, and conveniently of the elongated plate type, which extends in a position facing the dorsal upright 9 and substantially parallel to the axes 27 and has a lower end 29 stably connected to the hollow body 22 and an upper end portion 30 stably connected to the upper hollow body 23.

The guide 28 is coupled to a slide 32, which forms part of the unit 20, and which is stably connected to the end portions 16A of the shoulder straps 13.

The slide 32 is movable in opposite directions along the guide 28 under the thrust of a motorised mechanical transmission, indicated by the numeral 33. According to a variant not shown, the slide 32 is replaced by a carriage.

Preferably, the mechanical transmission 33 is of the rope type and comprises a driving pulley 34 coupled to the lower hollow body 22 so as to rotate about a fixed axis 35 substantially orthogonal to the guide 28 and to the coupling plate 21, and a guide idler pulley 36 coupled to the upper hollow body 23 so as to rotate about a fixed hinge axis 37 parallel to the axis 35. A rope 38 or a closed-ring belt, which has an arm 39 of which an intermediate portion is stably connected to the slide 32, is wound around the pulleys 34 and 36.

Figure 2:
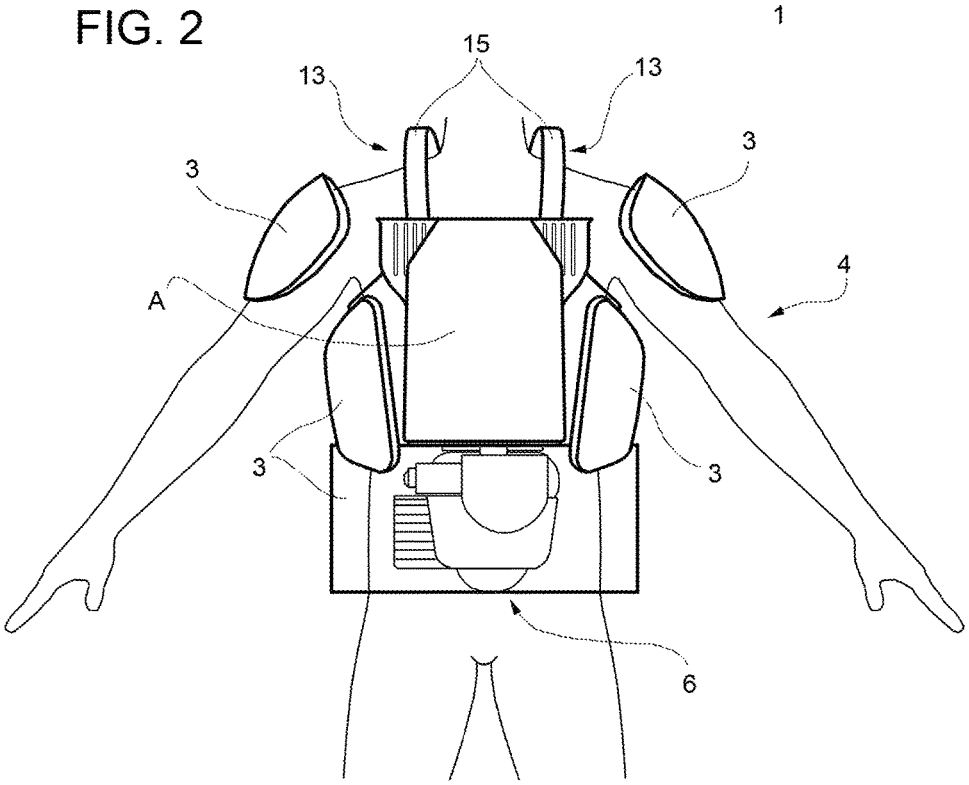

The bodies 25, the guide 28 and the slide 32 are protected by a ballistic plate A, visible in FIGS. 2, 3 and 4.

Still with reference to FIGS. 4 and 5, the pulley 34 is driven by a worm screw-worm wheel transmission 40 comprising a worm wheel 41 coaxial with the axis 35 and integrally connected to the pulley 34, and a screw 42 constituting the extension of the output shaft 43 of a direct current motor 44 stably connected to the hollow body 22 and powered by batteries B.

In the particular example described, the motor 44 extends in a direction orthogonal to the guide 28 and to the axis 35, so as to allow for the development of an extremely compact unit especially in a direction parallel to said axis 35. Also the rope transmission 33 contributes to the compactness of the unit 20 in the same direction.

According to a variant not shown, the motor 44 extends in a position parallel to the guide 28, so as to allow for the development of an extremely compact actuation unit in a direction orthogonal to the guide 28 and to the axis 35.

Whatever the arrangement of the motor 44, in use, by operating the motor 44, for example by remote control or by acting on a push-button panel located, for example, on the lumbar band 4 and anyway in a protected area easily accessible to the user 2, the slide 32 is moved along the guide 28 continually adjusting the length of the shoulder straps 13 between a position of maximum extension shown in FIGS. 3 and 5 and a position of minimum extension shown in FIGS. 4 and 6.

In this way, in any operating condition and regardless of the load carried, the user is autonomously able to continuously shift the load from the shoulders to the hips and vice versa, i.e. to distribute the carried load between the shoulders and the lumbar region, as needed. In particular, the use of an electric motor evidently allows the distribution of the load between the shoulders and the lumbar region to be customised and varied in a very short time, easily and without effort, with the desired frequency and with the user being in any position, i.e. regardless of whether the user is standing, seated in a vehicle, lying, etc., via a simple electrical control. This is important in situations of extreme overload, because it allows the considerable pressure on the shoulders or hips to be temporarily relieved, reducing the associated micro traumas and increasing the strength and resilience.

When the load is shifted to the hips, the stress on the spine and the work done by the muscles of the trunk decrease, allowing for a greater comfort of use and reducing fatigue.

In addition, again, when the load is shifted to the lumbar region, the straining actions of the ballistic protection against the body of the user are virtually eliminated, so that the ballistic protection is moved away from the body, as seen in FIG. 3. This allows the user to breathe freely and does not inhibit the natural body thermoregulation, allowing air to flow in the interspace defined by the ballistic protections, on one side, and by the user's body, on the other, and to remove the heat and moisture generated.

Instead, when the load is shifted to the shoulders, the system becomes more compact and stable. This configuration is more useful in the case of a temporary intense activity (running, jumping), because it increases the adhesion of the ballistic protections to the body and consequently reduces oscillations and impacts, which are possible sources of discomfort and distraction. Moreover, shifting the load to the shoulders allows the pressure on the hips to be temporarily relieved, enhancing the resilience and increasing the ability to withstand high loads.

In other words, the aforesaid supporting structure 1 allows for improving the safety and comfort of use, i.e. enables the user to reduce fatigue and hence to carry more weight with equal physical performance, or to obtain better physical performance while carrying the same weight.

Experimentally, it was found that, despite the additional weight compared to the known arrangements due to the motorised actuation, the aforesaid supporting structure 1 allows the user to carry, with equal physical performance, an additional weight greater than the weight of the motorised actuation, and therefore the system is actually advantageous in an energy-efficient way.

Lastly, from the above it is clear that modifications and variations may be made to the aforesaid wearable supporting structure 1 without departing from the scope of protection of the present disclosure.

In particular, both the motor 44 and the transmissions 33 and 40 described above could be different from those indicated by way of example or be arranged in different positions from those described and illustrated in the attached figures, but still such as to allow for a continuous distribution of the load between the shoulders and the hips or the lumbar region of the user.

The invention claimed is:

1. A wearable supporting structure for supporting ballistic protections and/or military equipment, the supporting structure comprising:

a band suitable to be wrapped around the waist or hips of a user;

a dorsal upright having a lower end coupled to said band, the dorsal upright extending, in use, upwards from said band;

at least one supporting member for supporting ballistic protections and/or other military equipment, the at least one supporting member being coupled to said dorsal upright and comprising two shoulder straps having respective rear end portions facing said dorsal upright; and a connection device connecting said rear end portions to said band; wherein said connection device comprises a motorised adjustment device for continuous adjustment of a position in height of said rear end portions with respect to said band wherein said motorised adjustment device comprises:

a) a slide or carriage;

b) a guide, and c) a motorized mechanical transmission;

said slide or carriage being coupled to said guide and being movable along said guide under a thrust of said motorized mechanical transmission.

2. The structure according to claim 1, wherein said motorised adjustment device comprises a rope transmission and a motor operating said rope transmission.

3. The structure according to claim 2, wherein said rope transmission comprises:

a driving wheel arranged in proximity of said band and operated by said motor;

a driven wheel carried by said dorsal upright; and a rope wound in a loop on said driving and driven wheels; said driving and driven wheels being rotatable about respective hinge axes placed at a fixed distance from each other.

4. The structure according to claim 3, wherein said motor has an output shaft orthogonal to said hinge axes.

5. The structure according to claim 2, wherein:

said guide is rectilinear, is integrally connected to said band, and extends along said dorsal upright, and said slide or carriage slides in opposite directions along said guide under the thrust of said rope transmission; said rear end portions of said shoulder straps both being stably connected to said slide or carriage.

6. The structure according to claim 1, comprising a first and a second hollow body, through each of which a respective shoulder strap passes; said hollow bodies being arranged on opposite lateral sides of said guide, and being both hinged to said dorsal upright to rotate about respective axes, substantially parallel to said guide.

7. The structure according to claim 2, wherein said motor has an output shaft parallel to said guide.

8. The structure according to claim 2, wherein said motorised adjustment device also comprises a worm screw-worm wheel transmission interposed between said motor and said rope transmission.

9. The structure according to claim 1, wherein said slide or carriage is distinct from said dorsal upright and is movable along said guide with respect to said dorsal upright.

10. A wearable supporting structure for supporting ballistic protections and/or military equipment, the supporting structure comprising:

a band suitable to be wrapped around the waist or hips of a user;

a dorsal upright having a lower end coupled to said band and extending, in use, upwards from said band;

supporting means for supporting ballistic protections and/or other military equipment, the supporting means being coupled to said dorsal upright and comprising two shoulder straps having respective rear end portions facing said dorsal upright; and connection means connecting said rear end portions to said band; wherein said connection means comprise motorised adjustment means for continuous adjustment of a position in height of said rear end portions with respect to said band, wherein said motorised adjustment means comprise a rope transmission and a motor operating said rope transmission.

11. The structure according to claim 10, wherein said rope transmission comprises a driving wheel arranged in proximity of said band and operated by said motor; a driven wheel carried by said dorsal upright; and a rope wound in a loop on said wheels; said wheels being rotatable about respective hinge axes placed at a fixed distance from each other.

12. The structure according to claim 11, wherein said motor has an output shaft orthogonal to said hinge axes.

13. The structure according to claim 10, wherein said motorised adjustment means further comprise a rectilinear guide integrally connected to said band and extending along said dorsal upright, and a slide sliding in opposite directions along said guide under the thrust of said rope transmission; said rear end portions of said shoulder straps both being stably connected to said slide.

* * * * *